US010654611B2

(12) United States Patent
Frost

(10) Patent No.: US 10,654,611 B2
(45) Date of Patent: May 19, 2020

(54) RETAIL READY PACKAGING

(71) Applicant: Vanguard Packaging, Inc., Kansas City, MO (US)

(72) Inventor: Jerry Ryan Frost, Kansas City, MO (US)

(73) Assignee: VANGUARD PACKAGING, LLC, Kansas City, MO (US)

( * ) Notice: Subject to any disclaimer, the term of this patent is extended or adjusted under 35 U.S.C. 154(b) by 612 days.

(21) Appl. No.: 14/960,747

(22) Filed: Dec. 7, 2015

(65) Prior Publication Data

US 2016/0159513 A1 Jun. 9, 2016

Related U.S. Application Data

(60) Provisional application No. 62/088,163, filed on Dec. 5, 2014.

(51) Int. Cl.

| | |
|---|---|
| ***B65D 5/02*** | (2006.01) |
| ***B65D 5/42*** | (2006.01) |
| ***B65B 43/10*** | (2006.01) |
| ***B65D 5/54*** | (2006.01) |

(52) U.S. Cl.

CPC ..... *B65D 5/02* (2013.01); *B65D 5/4212* (2013.01); *B65D 5/4266* (2013.01); *B65D 5/5445* (2013.01); *B65D 5/0227* (2013.01)

(58) Field of Classification Search

CPC ..... B65D 5/02; B65D 5/4212; B65D 5/4266; B65D 5/445; B65D 5/54; B65D 5/52; B65D 5/4608; B65D 5/42; B65B 43/10

USPC ..... 229/242, 164, 235, 240, 103, 117.16, 229/241, 243; 206/774, 736, 746, 772

See application file for complete search history.

(56) References Cited

U.S. PATENT DOCUMENTS

| | | | |
|---|---|---|---|
| 3,592,337 | A | 7/1971 | Phillips, Jr. et al. |
| 3,640,010 | A | 2/1972 | Altman et al. |
| 3,786,914 | A | 1/1974 | Beutler |
| 3,829,006 | A | 8/1974 | Spiegel |
| 4,000,811 | A | 1/1977 | Hardison et al. |
| 4,113,100 | A | 9/1978 | Soja et al. |
| 4,279,375 | A | 7/1981 | Gardner |

(Continued)

FOREIGN PATENT DOCUMENTS

| | | |
|---|---|---|
| AU | 2003204840 | 1/2004 |
| AU | 2008200127 | 7/2008 |

(Continued)

OTHER PUBLICATIONS

Delkor, Delkor Cabrio Case, Website: http://www.delkorsystems.com/product/delkor-cabrio-case; Accessed Dec. 7, 2015.

(Continued)

*Primary Examiner* — Christopher R Demeree

(74) *Attorney, Agent, or Firm* — Kutak Rock LLP

(57) ABSTRACT

A shipping and display container having a plurality of panels defining a tray portion and a cover portion removably coupled to the tray portion. The container includes a separating line that bisects various panels of the container so that after the container is received at a retail point-of-sale location, the cover portion can be separated from the tray portion. After the cover portion is separated from the tray portion, the cover portion is discarded and the tray portion is utilized as a retail display tray.

15 Claims, 3 Drawing Sheets

(56) References Cited

U.S. PATENT DOCUMENTS

| | | | | |
|---|---|---|---|---|
| 4,350,281 | A | 9/1982 | Dornbusch et al. | |
| 4,417,685 | A | 11/1983 | Forbes, Jr. | |
| 4,448,303 | A | 5/1984 | Beckenfield | |
| 4,542,847 | A | 9/1985 | Lindstrom | |
| 4,694,955 | A | 9/1987 | Rank, Jr. | |
| 4,750,612 | A | 6/1988 | Schuster | |
| 5,363,954 | A | 11/1994 | Dampier et al. | |
| 5,398,869 | A | 3/1995 | Dickson et al. | |
| 5,657,872 | A | 8/1997 | Leftwich et al. | |
| 5,704,193 | A | 1/1998 | Roe et al. | |
| 5,894,933 | A | 4/1999 | Crews et al. | |
| 5,950,914 | A | 9/1999 | Dunton et al. | |
| 5,979,749 | A * | 11/1999 | Bozich | B65D 5/5445 229/160.2 |
| 6,109,514 | A | 8/2000 | Otis | |
| 6,135,289 | A | 10/2000 | Miller | |
| 6,189,780 | B1 | 2/2001 | Kanter | |
| 6,405,921 | B1 | 6/2002 | Cochrane | |
| 6,640,975 | B2 | 11/2003 | Bennett et al. | |
| 6,948,616 | B2 | 9/2005 | Gillani | |
| 7,004,897 | B2 | 2/2006 | Spivey, Sr. | |
| 7,080,736 | B2 | 7/2006 | Jackson et al. | |
| 7,225,930 | B2 | 6/2007 | Ford et al. | |
| 7,284,662 | B2 | 10/2007 | DeBusk et al. | |
| 7,484,655 | B2 | 2/2009 | McLeod | |
| 7,743,969 | B2 | 6/2010 | Bokel | |
| 7,823,732 | B2 | 11/2010 | Lutkauskas et al. | |
| 7,870,994 | B2 | 1/2011 | Spivey, Sr. et al. | |
| 8,342,335 | B2 | 1/2013 | Couture | |
| 8,376,141 | B2 | 2/2013 | Couture | |
| 8,430,296 | B2 * | 4/2013 | Mathieu | B65D 5/68 229/125.19 |
| 8,789,703 | B2 | 7/2014 | Couture et al. | |
| 9,302,845 | B2 | 4/2016 | Kawka et al. | |
| 9,382,401 | B2 | 7/2016 | Haraguchi et al. | |
| 9,828,131 | B2 * | 11/2017 | James | B65D 5/5286 |
| 2004/0231296 | A1 | 11/2004 | Daniels | |
| 2006/0054676 | A1 | 3/2006 | Wischusen, III | |
| 2006/0261140 | A1 | 11/2006 | Holley, Jr. | |
| 2007/0023436 | A1 | 2/2007 | Sierra-Gomez et al. | |
| 2008/0087556 | A1 | 4/2008 | Henke et al. | |
| 2009/0014352 | A1 * | 1/2009 | Foden | B65D 5/5445 206/746 |
| 2009/0134058 | A1 | 5/2009 | Alexander | |
| 2009/0314661 | A1 | 12/2009 | Fisher et al. | |
| 2010/0243517 | A1 | 9/2010 | Agalopoulos et al. | |
| 2010/0276333 | A1 * | 11/2010 | Couture | B65D 5/5445 206/774 |
| 2012/0085817 | A1 * | 4/2012 | Gatrost | B65D 5/5445 229/240 |

FOREIGN PATENT DOCUMENTS

| | | | |
|---|---|---|---|
| EP | 0442179 | A1 | 8/1991 |
| GB | 495572 | | 11/1938 |
| GB | 1000243 | | 8/1965 |
| GB | 1147977 | | 4/1969 |
| GB | 2263691 | | 8/1993 |
| GB | 2419347 | | 6/2006 |
| WO | 2008130983 | A1 | 8/2008 |

OTHER PUBLICATIONS https://www.copybook.com/companies/smurfit-kappa-uk/articles/fusion-packaging-launched-by-smurfit-kappa last accessed on May 9, 2019.

* cited by examiner

RETAIL READY PACKAGING

CROSS-REFERENCE TO RELATED APPLICATIONS

This application claims priority pursuant to 35 U.S.C. 119(e) to U.S. Provisional Patent Application Ser. No. 62/088,163, filed Dec. 5, 2014, the entire disclosure of which is incorporated herein by reference.

FIELD OF THE INVENTION

The present invention relates generally to the field of retail ready packaging containers. More specifically, the present invention is concerned with corrugated, paperboard shipping or storage containers that are manufactured in a fold and glue assembly process such that the containers can be quickly, easily, and safely converted to a shelf-ready display tray.

BACKGROUND OF THE INVENTION

Corrugated packaging and shipping containers are typically made from pieces of flat paperboard stock material that are die cut into shapes that define various panels. The shapes are folded along predefined lines between the panels with at least one overlapping strip or panel that is glued, taped, or otherwise affixed to another panel to form an enclosed boundary. The panels are folded and/or glued into place to become the walls of the container. The containers are traditionally provided to product manufacturers and/or shippers in a collapsed, flat, or knock-down configuration for storage, handling, and shipping. The manufacturers and/or shippers open the knockdown containers and fold appropriately to utilize the assembled container for packing and/or shipping the items therein.

The knock-down containers are typically manufactured by feeding flat die cut sheets through a fold-and-glue machine. The fold-and-glue machine applies adhesive and folds over select panels so that the panels are in the knock-down configuration. One common knock-down container is a display tray. A display tray is typically used to display items to consumers at a retail point-of-sale location. Often, however, the items are placed in the display trays by a manufacturer and/or a shipper prior to the items being shipped to the retail point-of-sale. To protect the items during shipping, separate shipping covers are placed over the items and display trays and/or the items and display trays are placed within a full shipping container. These two-part vehicles add considerably to the assembly labor as well as material costs associated with shipping and displaying the items. Furthermore, prior to placing the items on display, the shipping cover and/or shipping container must be cut open with a knife at the retail point-of-sale location. This creates a risk of injury to retail personnel and increases the risk that the items will be damaged. Therefore, it would be beneficial to provide display trays and shipping covers that are capable of sufficiently protecting items during shipping without requiring cutting to separate the shipping covers from the display trays at the retail point-of-sale locations.

SUMMARY OF THE INVENTION

The present invention comprises a corrugated shipping container comprising a tray portion and a cover portion removably coupled to the tray portion. When the cover portion is coupled to the tray portion, the shipping container defines an enclosed volume within which items may be positioned for shipping. When the cover portion is removed from the tray portion, the items are revealed to consumers in an aesthetically pleasing manner so as to encourage consumers to remove the items from the tray portion for purchase.

The container is moveable between a knock-down configuration, a loading configuration, and a shipping configuration. In the knock-down configuration, the shipping container is relatively flat so as to accommodate shipping and/or storage of multiple shipping containers. In the loading configuration, the shipping container defines an interior area and an opening through which items pass when being placed within the interior area. In the shipping configuration, the shipping container defines an enclosed volume within which items may be located during shipping.

The present invention is also moveable from a shipping configuration to a display configuration by decoupling a cover portion of the shipping container from a tray portion of the shipping container and removing the cover portion from the tray portion. In some embodiments, a separating line bisects a plurality of panels of the shipping container so as to define a top portion and a bottom portion of each bisected panel. The top portions of the panels make up part or all of the cover portion of the shipping container. The bottom portions of the panels and the bottom flanges make up part or all of the tray portion of the shipping container. The separating line is defined by one or more slits, perforations, and/or other features so as to weaken the panels at the separating line so that the cover portion and the tray portion will separate in a predictable and desirable manner. Furthermore, by weakening the panels at the separating line, less force is required to separate the cover portion from the tray portion. In various embodiments, the separating line is designed to have an aesthetically pleasing appearance, and/or to aesthetically display the items within the items within the tray portion of the shipping container. In some embodiments, the separating line is designed to display various aesthetic shapes, such as logos or other indicia related to the items within the shipping container.

The present invention also includes a method of making a shipping and display container. The method includes cutting a single flat piece of material, such as corrugated paperboard, into a pre-determined flat-pattern configuration. The flat-pattern configuration includes a main panel section, a plurality of upper and lower tabs extending from respective upper and lower edges of the main panel section, and a corner tab extending from a first end of the main panel section. The main panel section and the corner tab are bisected by a separating line.

In some embodiments, fold lines are added to the material at or near the edges and/or ends of the main panel section and/or in-between individual panels within the main panel section. In this way, fold lines define a plurality of panels within the main panel section and assist in moving the shipping container from the flat pattern configuration to a three-dimensional configuration. In some embodiments, each panel is bisected by the separating line. In other embodiments, at least one panel section is not bisected by the separating line.

While in the knock-down configuration, the shipping container is easy to store until it is needed to ship items/products. Prior to shipping products within the shipping container, the shipping container is moved from the knock-down configuration to the packing configuration. While in the packing configuration, products are placed within an interior area of the shipping container. The shipping container is then moved from the packing configuration to the shipping configuration so as to retain the products within the shipping container during shipping. Finally, the shipping container is moved from the shipping configuration to the display configuration by separating a tray section of the shipping container from a cover section of the shipping container. The tray section is used to display the products at a retail point-of-sale location and the cover section is discarded.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
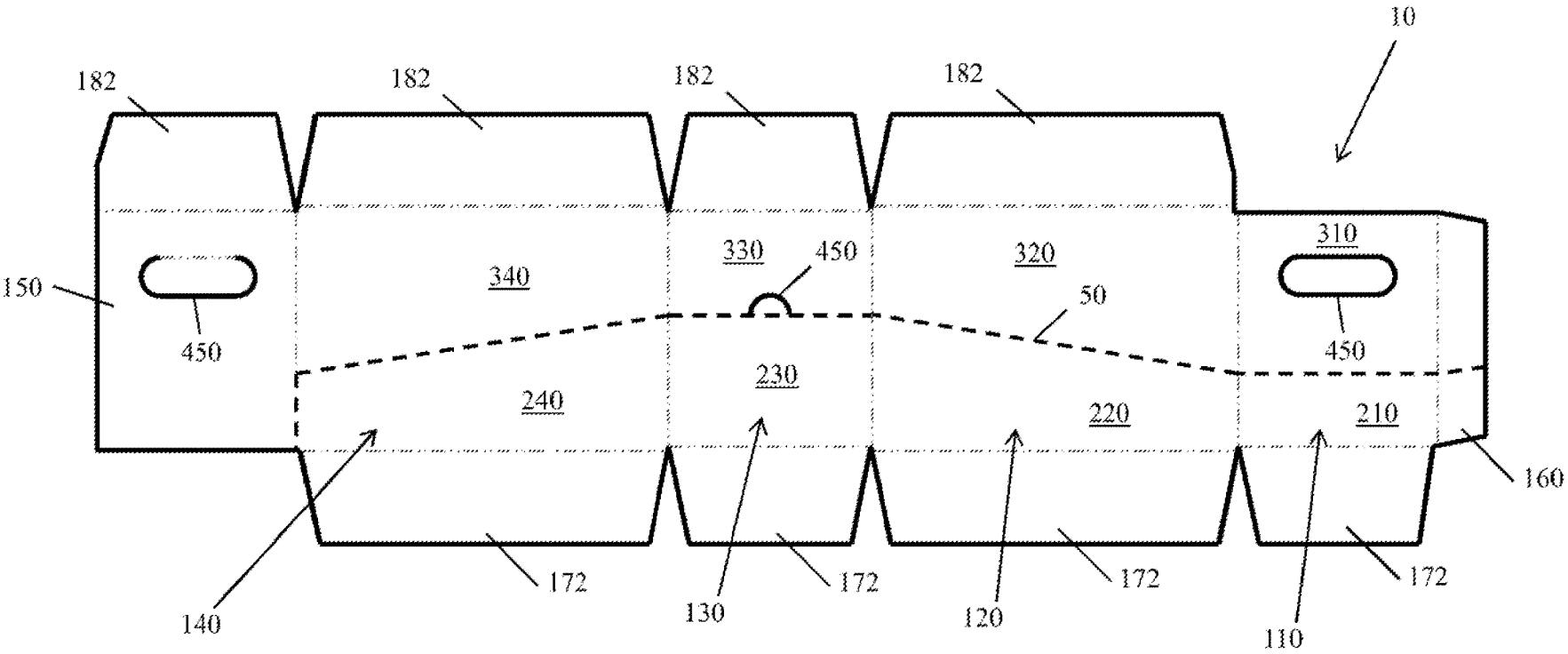
FIG. 1 is a top view of a flat pattern of a preferred embodiment of the present invention.
Figure 2:
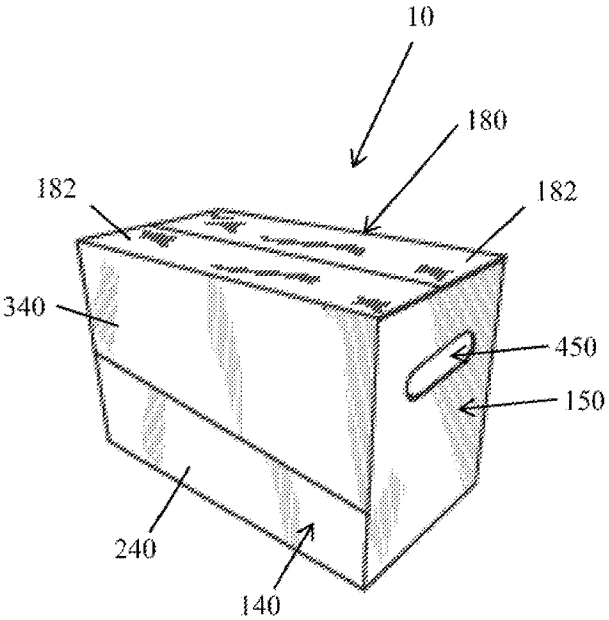
FIG. 2 is a perspective view of a preferred embodiment of a shipping and display container of the present invention, the container being shown in a shipping configuration.

Referring to FIGS. 1 and 2, the present invention comprises a shipping and display container 10 comprising a tray portion 200 and a cover portion 300 removably coupled to the tray portion 200. The container is moveable between a flat configuration (FIG. 1), a knock-down configuration (not shown), a loading configuration (not shown), and a shipping configuration (FIG. 2). In the knock-down configuration, the shipping container 10 is relatively flat so as to accommodate shipping and/or storage of multiple shipping containers 10. In the loading configuration, the shipping container defines an interior area (not shown) and an opening (not shown) through which items pass when being placed within the interior area. In the shipping configuration, the shipping container defines an enclosed volume within which items (not shown) may be located during shipping.

Figure 3:
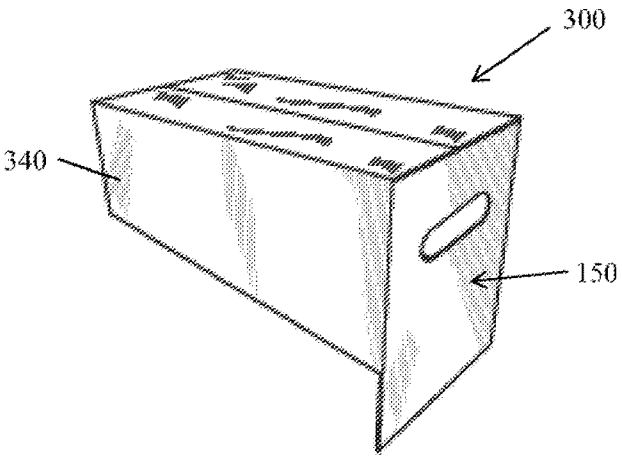
FIG. 3 is a perspective view of a cover portion of a preferred embodiment of the present invention.
Figure 4:
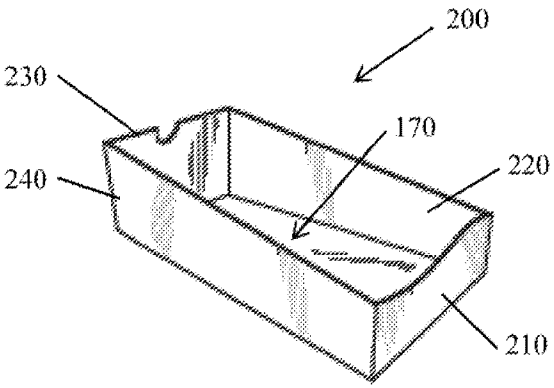
FIG. 4 is a perspective view of a tray portion of a preferred embodiment of the present invention.

Referring to FIGS. 3 and 4, the present invention is also moveable from a shipping configuration to a display configuration by decoupling the cover portion 300 of the shipping container 10 from the tray portion 200 of the shipping container 10 and removing the cover portion 300 from the tray portion 200.

Some embodiments of the present invention include a first front panel 110, a rear panel 130, and opposed first and second side panels 120, 140 extending between the first front 110 and rear 130 panels. Each panel includes a top edge and a bottom edge. In some such embodiments, a bottom flap 172 extends from each bottom edge such that when the bottom flaps 172 are folded against each other they form a bottom support structure 170 for supporting items within the interior area of the container. In other such embodiments, a top flap 182 extends from each top edge such that when the top flaps 182 are folded against each other they form a top support structure 180. In this way, the top 180 and bottom 170 support structures extend between the first front 110, rear 130, and first 120 and second 130 side panels so as to define a concealed interior volume for holding items during storage and/or shipping. It will be appreciated that, in some embodiments, the container 10 does not include a rear panel 130 and/or the side panels 120, 140 are formed from a plurality of panels so as to form containers 10 and/or tray portions 200 having a variety of different shapes and sizes.

Figure 5:
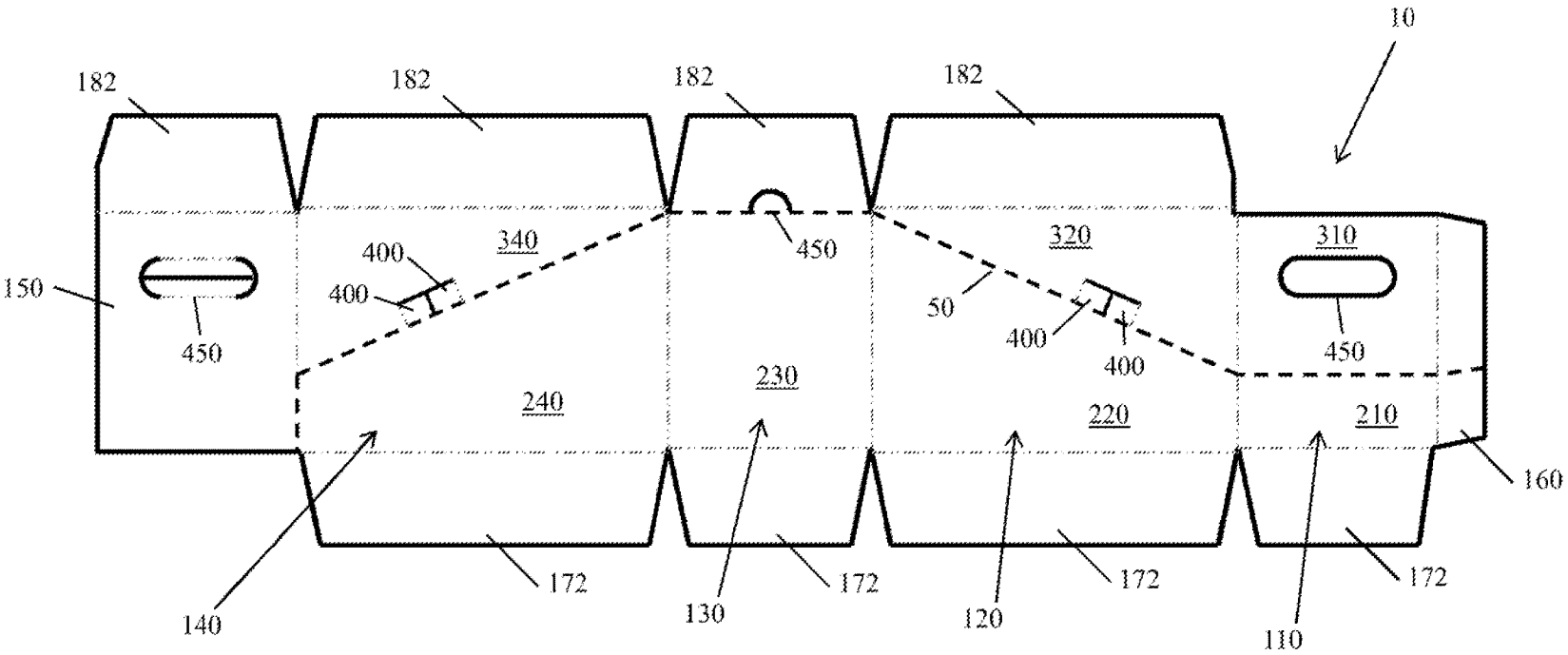
FIG. 5 is a top view of a flat pattern of another preferred embodiment of the present invention.
Figure 6:
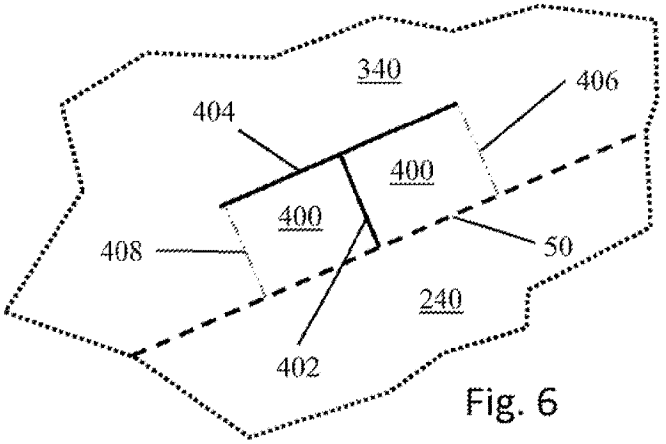
FIG. 6 is an isolated view on an enlarged scale of a portion of FIG. 5.

Referring to FIGS. 1 and 5, a preferred embodiment of the present invention is formed by cutting a profile of a single piece of material from a flat piece of material and forming a plurality of fold lines within the profile so as to form a plurality of interconnected panels from the single flat piece of material. In some embodiments, the profile includes a plurality of flanges and/or flaps extending from at least some of the panels. In some such embodiments, each flange extends linearly from its respective panel and each panel extends linearly from at least one adjacent panel such that each flange and each panel is essentially parallel with all other flanges and panels. In this way, the shipping container is relatively flat so as to accommodate shipping and/or storage of multiple shipping containers.

The profile includes first 120 and second 140 side panels and a first front panel 110. The first 120 and second 140 side panels each include opposed front and rear edges and opposed top and bottom edges extending between respective front and rear edges. The first front panel 110 includes a proximal end hingedly coupled to the front edge of the first side panel 120, an opposed distal end, and opposed top and bottom edges extending between opposed proximal and distal ends. In some embodiments, a rear panel 130 having opposed first and second edges and opposed top and bottom edges extending between the first and second edges is formed between the first 120 and second 140 side panels. In some such embodiments, the first edge of the rear panel 130 is hingedly coupled to the rear edge of the first side panel 120 at a first fold line and the second edge of the rear panel 130 is hingedly coupled to the rear edge of the second side panel 140 at a second fold line.

In a preferred embodiment, each of the first front panel 110 and the first 120 and second 130 side panels are bisected by a separating line 50 while maintaining the flat piece of material as a single piece of material. In some embodiments, the separating line 50 extends through one or more other panel, such as a flange, a flap, a tab, and/or some other type of panel, so as to bisect such panel. In other embodiments, the bisecting line 50 extends at least partially between one or more panel. In some embodiments, the separating line 50 is a continuous line that extends substantially across the length of the flat piece of material. In some such embodiments, as shown in FIG. 1, the separating line 50 extends through the rear panel 130, thereby bisecting the rear panel 130. In other such embodiments, as shown in FIG. 5, the separating line 50 extends past the rear panel 130, such as along the top edge of the rear panel 130, such that the rear panel 130 is not bisected. In some such embodiments, the separating line 50 extends between the rear panel 130 and an adjacent panel, such as a top flap 182 extending from the top edge of the rear panel 130. It will be appreciated that, in some embodiments, the front panel 110 and/or one or more of the first 120 and second 140 side panels is not bisected by the separating line. It will also be appreciated that, in other embodiments, one or more panel is bisected so as to coordinate with one or more other bisected and/or non-bisected panel when the cover portion is removed from the tray portion. In some such embodiments, such coordination involves having the size and/or shape of one bisected panel generally match the size and shape of another panel. In other such embodiments, such coordination involves having the size and/or shape of one bisected panel contrast with another panel.

In a preferred embodiment, the separating line 50 is configured to maintain each bisected panel as a single panel when the container 10 is in the flat, knock-down, packing, and/or shipping configuration. The separating line 50 is also configured to more easily accommodate separating the cover portion 300 from the tray portion 200 so as to allow the container 10 to be more easily moved to the display configuration. In some embodiments, the separating line 50 accommodates separating the cover portion 300 from the tray portion 200 without the use of tools, such as knives. In some such embodiments, the separating line 50 is formed from a plurality of line segments, at least some such line segments being cut lines and at least other such line segments being perforated lines. In other such embodiments, the separating line 50 is configured to couple adjacent panels (such as the rear panel 130 and the adjacent top flap 182 shown in FIG. 5) together when the container 10 is in the flat, loading/packing, and/or shipping configuration while accommodating separation of the adjacent panels so as to accommodate moving the container to the display configuration.

In a preferred embodiment, the container is moved from the flat configuration to the shipping configuration by folding the flat piece of material along the plurality of fold lines. In some such embodiments, this includes folding the first front panel 110 away from the first side panel 120 and folding the second side panel 140 towards the distal end of the first front panel 110 so that the first front panel extends generally between respective front edges of the first 120 and second 140 side panels. In some such embodiments, the container includes a vertical tab member 160 having opposed proximal and distal ends, the proximal end of the vertical tab member 160 being hingedly attached to the distal end of the first front panel 110 such that the first front panel 110 is capable of being secured relative to the second side panel 140 by folding the vertical tab member 160 against the second side member 140 and securing the vertical tab member 160 to the second side member 140.

Referring to FIG. 3, the tray portion 200 includes a bottom support structure 170 and a plurality of vertical walls extending vertically upwards from the bottom support structure 170. In some embodiments, the vertical walls include opposed front 210 and rear 220 walls and opposed first 220 and second 240 side walls extending between the front 210 and rear 220 walls. In some such embodiments, the rear wall 230 is taller than the front wall 210 and the first 220 and second 240 side walls vary in height with a front portion of the side walls being generally the same height as the front wall 210 and a rear portion of the side walls being generally the same height as the rear wall 230.

Referring to FIG. 4, the cover portion 300 includes a top support structure 180 and a plurality of vertical walls extending vertically downwards from the bottom support structure 180. In some embodiments, the vertical walls include opposed front 310 and rear 320 walls and opposed first 320 and second 340 side walls extending between the front 310 and rear 320 walls. In some such embodiments, the rear wall 330 is shorter than the front wall 310 and the first 320 and second 340 side walls vary in height with a front portion of the side walls being generally the same length as the front wall 310 and a rear portion of the side walls being generally the same length as the rear wall 330

In a preferred embodiment, the various walls of the tray portion 200 and the cover portion 300 are formed from the various panels of the container by bisecting the panels with the separating line 50. In some embodiments, the separating line 50 bisects the first front panel 110, thereby forming the front walls 210, 310 of respective tray 200 and cover 300 portions. In other embodiments, the separating line 50 bisects the first 120 and second 140 side panels, thereby forming respective first 220, 320 and second 240, 340 side panels of respective tray 200 and cover 300 portions. In still other embodiments, the separating line 50 bisects the rear panel 130, thereby forming the rear walls 230, 330 of respective tray 200 and cover 300 portions.

In a preferred embodiment, the container comprises a second front panel 150 having opposed proximal and distal ends and opposed top and bottom edges extending between said proximal and distal ends. In some embodiments, the proximal end is coupled to the front edge of the second side panel 140 and the distal end is positioned relatively adjacent to the front edge of the first side panel 120. In some embodiments, the second front panel 150 extends over the first front panel 110 when the container 10 is in the loading and/or shipping configuration. In some such embodiments, the second front panel 150 is configured to conceal the first front panel 110 from view when the second front panel 150 extends over the first front panel 110.

In a preferred embodiment, the separating line 50 extends partially between the second front panel 150 and the second side panel 140 such that when the cover portion 300 is removed from the tray portion 200, the entire second front panel 150 is retained with the cover portion 300. In some embodiments, the portion of the separating line 50 that extends between the second front panel 150 and the second side panel 140 extends along a front edge of the second side wall 240 of the tray portion 200. In some such embodiments, the portion of the separating line 50 extending along the front edge of the second side wall 240 is a cut line such that the second front panel 210 is not directly coupled to the second side wall 240 of the tray portion 200. In other such embodiments, at least part of the portion of the separating line 50 extending along the front edge of the second wall 240 is a perforation line and/or the second front panel 210 is otherwise at least partially coupled to the tray portion 200 in one or more location when the container 10 is in the loading and/or shipping configuration.

In some embodiments, the front wall 210 of the tray portion 200 includes indicia of colors, pictures, drawings, patterns, letters, numbers, words, or the like. In some such embodiments, the indicia is intended to provide information pertaining to items that are shipped in the container 10 and displayed by the tray portion 200. In other embodiments, the indicia is intended to entice consumers into purchasing such items. In some embodiments, the second front panel 150 is configured to conceal and/or to otherwise protect the indicia on the front wall 210 of the tray portion 200 when the container is in the loading and/or shipping configuration.

In some embodiments, the second front panel 150 includes indicia. In some such embodiments, the indicia includes information pertaining to shipping of items within the container 10, information pertaining to storage of the items, information pertaining to display of the items, information pertaining to removing the cover portion 300 from the tray portion 200, or the like.

In some embodiments, the container includes one or more aperture 450 defined by one or more panel of the container 10. In some such embodiments, the aperture 450 is configured to enable a user to more easily grasp a portion of the container 10, such as the cover portion 300 or the tray portion 200, when the user is separating the cover portion 300 from the tray portion 200.

In some embodiments, the aperture 450 is a thumb or finger hole that is configured to allow a user to place a finger, a thumb, or a similar sized item or object into the aperture 450 so as to assist with separating the cover portion 300 from the tray portion 200. In other embodiments, the aperture is a hand hole that is configured to allow a substantial portion of a user's hand to be received by the aperture 450 so as to allow the user to more easily grasp a portion of the container when moving the container and/or when separating the cover portion 300 from the tray portion 200.

In some embodiments, the container 10 includes one or more access flap 400 that is formed from one or more panel of the container 10. In some such embodiments, the access flap 400 includes a first edge that is defined by the separating line 50 and a second edge that is defined by a first cut line 402. The access flap 400 is configured such that pushing inwards on the access flap 400 enables a user to more easily grasp a portion of the container 10, such as the cover portion 300 or the tray portion 200, when the user is separating the cover portion 300 from the tray portion 200. In some embodiments, the access flap 400 is formed from the first 120 and/or second 140 side walls. In some such embodiments, at least one access flap 400 is formed in the first side wall 120 and at least one access flap 400 is formed in the second side wall 140 directly opposed to the access flap 400 on the first side wall 120 such that by utilizing each access flap 400, a user is able to more easily grasp each side of the container 10.

In some embodiments, the one or more access flaps 400 are formed from the cover portion 300 of the container. In some such embodiments, the one or more access flap 400 is formed from the front wall 210, the rear wall 230, and/or the first 220 and/or second 240 side wall.

In some embodiments, the first cut line 402 extends generally perpendicularly from the separating line 50 towards a second cut line 404. In some such embodiment, the second cut line 404 defines a third edge of the access flap. In other such embodiments, the second cut line 404 extends generally perpendicularly from the first cut line towards a first fold line 406 such that when a user pushes in on the access flap 400, the access flap 400 folds inward about the first fold line 406.

In some embodiments, the second cut line 404 extends generally perpendicularly from the first cut line 402 towards a second fold line 408 such that the separating line and the first 402 and second 404 cut lines define two access flaps, with one being hingedly coupled to the container at the first fold line 406 and the other being hingedly coupled to the container at the second fold line 408.

Although the container 10 is configured so that the cover portion 300 is easily removable from the tray portion 200, it will be appreciated that the container 10 is also configured such that the cover portion 300 remains securely coupled to the tray portion 200 during shipping. In some embodiments, at least one panel defines at least one aperture 450 that is configured to receive at least one finger or thumb of a user such that a user can more easily apply sufficient force to separate the cover portion 300 from the tray portion 200 at the separating line 50. Some such apertures 450 include a punch-out flange so that all or part of the aperture 450 is closed until just prior to removing the cover portion 300 from the tray portion 200.

In some embodiments of the present invention, the first 110 and second 150 front panels are formed from a single front panel with the first front panel 110 being formed from an inner portion of single front panel and the second front panel 150 being formed by an outer portion of the single front panel. In some such embodiments, the inner portion is bisected by the a separating line 50 such that a lower portion of the inner panel forms at least part of the front wall 210 of the tray portion 200 and the upper portion of the inner panel forms at least part of the front wall 310 of the cover portion 300. In some embodiments, the separating line 50 does not extend through the outer panel. In some such embodiments, the entire outer portion of the single front panel is part of the cover portion 300 of the container 10. In some embodiments, the outer portion is coupled to a top portion of the inner panel and extends over at least part of the bottom portion of the inner panel when the cover portion 300 is coupled to the tray portion 200. In this way, the outer panel conceals and protects at least part of the separating line 50 and conceals and protects at least part of the bottom portion of the inner panel. When the cover portion 300 is separated from the tray portion 200, the bottom portion of the inner panel is revealed.

In other embodiments, such as shown in FIGS. 1 and 5, a separating line 50 bisects a plurality of panels of the shipping container so as to define a top portion and a bottom portion of each bisected panel. The top portions make up part or all of the cover portion 300 of the shipping and display container 10 and the bottom portions make up part or all of the tray portion 200 of the shipping and display container. The separating line 50 is defined by one or more slits, perforations, and/or other features so as to weaken the panels at the separating line 50 so that the cover portion 300 and the tray portion 200 will separate in a predictable and desirable manner. Furthermore, by weakening the panels at the separating line 50, less force is required to separate the cover portion 300 from the tray portion 200.

In a preferred embodiment, the shipping and display container can be moved from the flat-pattern configuration to a display configuration. In some embodiments, this process includes the intermediate processes of moving the shipping container from the flat-pattern configuration to a knock-down configuration; from the knock-down configuration to the loading configuration; from the loading configuration to the shipping configuration; and from the shipping configuration to the display configuration.

Moving the container 10 from the flat-pattern configuration to the knock-down configuration includes several steps. First, the flat-pattern is placed on a flat surface with an inner surface of each panel facing upwards. Next, the first front panel 110 is folded over the first side panel 120 so as to expose an exterior surface of the vertical tab member 160 and the first front panel 110. Next, adhesive is applied to the exterior surface of the vertical tab member 160 and an upper portion of the first front panel 110 that corresponds with the front wall 310 of the cover portion 300. Adhesive is not applied to the lower portion of the first front panel 110 that corresponds with the front wall 210 of the tray portion 200. The second side panel 140 is then folded over the rear panel 130 such that an inner surface of the second side panel 140 comes into contact with the outer surface of the vertical tab member 160 and the inner surface of the second front panel 150 comes into contact with the outer surface of the first front panel 110. In this way, the vertical tab member 160 is secured to the second side panel 140 and the front wall 310 of the cover portion 300 is secured to the second front panel 150 so as to secure the container 10 in a relatively flat knock-down configuration without directly coupling the front wall 210 of the tray portion 200 to the second front panel 150.

While in the knock-down configuration, the container 10 is easy to store until it is needed to store and/or ship items. Prior to shipping items within the container 10, the container 10 is moved from the knock-down configuration to the packing configuration. In some embodiments, this is accomplished by folding the first front panel 110 away from the first side panel 120, thereby causing the second side panel 140 to move away from the first side panel 120. In some such embodiments, a plurality of bottom flaps 172 extending from one or more of the panels are folded inward towards each other and are secured together with tape, glue, or some other bonding agent or mechanism so as to create a bottom support structure 170.

While in the packing configuration, items are placed within an interior area of the container 10. The container 10 is then moved from the packing configuration to the shipping configuration. In some embodiments, this is accomplished by folding a plurality of top flaps 182 against each other so as to form a top support structure 180. In some such embodiments, one or more of the top flaps 182 extends from one or more of the panels.

While in the shipping configuration, the items are secured safely within the container so as to accommodate shipping and storing of the items. In some embodiments, the items remain within the container until the container is moved from the shipping configuration to the display configuration. In some embodiments, this is done by separating the cover portion 300 of the container 10 from the tray portion 200 of the container 10. In some such embodiments, this enables the tray portion 200 to be used as a display for the items at a retail point-of-sale location. In other such embodiments, the cover portion 300 is discarded.

In some embodiments, the second front panel 150 is secured to the tray portion 200 in such a way as to accommodate separating the second front panel 150 from the tray portion 200 without damaging items positioned within the container 10. In some such embodiments, a piece of tape or other bonding means extends from a bottom surface of the bottom structure 170 to a front surface of the second front panel 150 and/or from an exterior surface of the first 120 and/or second 140 side panels to a front surface of the second front panel 150. In other such embodiments, a bonding means is positioned between the second front panel 150 and the front wall 210 of the tray portion 200. In some embodiments, the tape and/or other bonding means is capable of being broken and/or otherwise un-bonded by gently prying the second front panel 150 away from the front wall 210 of the tray portion 200. In other embodiments, the tape and/or other bonding means is capable of being broken and/or otherwise un-bonded by inserting an object, such as a blade, between the second front panel 150 and the front wall 210 of the tray portion 200. In such embodiments, the second front panel 150 serves as a barrier between the user and the object so as to reduce the risk of harm to the user and the front wall 210 of the tray portion 200 serves as a barrier between the items and the object so as to reduce the risk of damage to the items.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A separable container moveable from a shipping configuration to a display configuration by separating a cover portion of the container from a tray portion of the container, the container being configured for shipping or storing items when the container is in the shipping configuration and for displaying items when the container is in the display configuration, the shipping configuration of the container comprising:

opposed first and second side panels, each side panel comprising an upper portion and a lower portion;

a first front panel extending between respective front edges of said first and second side panels, said first front panel comprising an upper portion and a lower portion; and a second front panel coupled to said upper portion of said first front panel, said second front panel extending over said lower portion of said first front panel when the container is in the shipping configuration, thereby concealing said lower portion of said first front panel, wherein said upper and lower portions of said first front panel and said first and second side panels are bisected by a separating line, wherein said separating line is configured to retain respective upper portions of said first and second side panels to respective lower portions of said first and second side panels when the container is in the shipping configuration, wherein separating said cover portion of the container from said tray portion of the container comprises separating respective upper portions of said first and second side panels from respective lower portions of said first and second side panels along said separating line, wherein said tray portion comprises a front wall formed from said lower portion of said first front panel of the container and opposed first and second side walls formed from respective lower portions of said first and second side panels of the container, wherein said cover portion comprises a first front wall formed from said upper portion of said first front panel of the container and opposed first and second side walls formed from respective upper portions of said first and second side panels of the container, wherein said cover portion comprises said second front panel such that moving the container to the display configuration causes a front surface of said front wall of said tray to be revealed, wherein a proximal end of said second front panel is coupled to a first portion of said front edge of said second side panel and wherein an opposed distal end of said second front panel is positioned relatively adjacent to said front edge of said first side panel, said first portion of said front edge of said second side panel consisting of at least a portion of said front edge that is defined by said upper portion of said second side panel, and wherein a first portion of said separating line extends between said second front panel and said second side wall of said tray, said first portion of said separating line consisting of a cut line that is a complete cut between said second front panel and said second side wall of said tray such that said second front panel is not directly coupled to said second side wall of said tray portion when the container is in the shipping configuration.

2. The container of claim 1, wherein said front surface of said front wall of said tray portion includes indicia, the indicia being intended to provide at least one of information pertaining to the items and marketing materials for enticing consumers to purchase the items.

3. The container of claim 1, wherein the second front panel includes indicia, the indicia being intended to provide at least one of information pertaining to shipping of the items, information pertaining to storage of the items, information pertaining to display of the items, or information pertaining to removing said cover portion from said tray portion.

4. The container of claim 1, further comprising an access flap formed from said first side panel, said access flap having a first edge defined by said separating line and a second edge defined by a first cut line extending away from said separating line, said access flap being configured such that pushing inwards on said access flap enables a user to more easily grasp said cover portion so as to more easily separate said cover portion from said tray portion.

5. The container of claim 4, wherein said access flap is formed from said first side wall of said cover portion.

6. The container of claim 4, wherein said first cut line extends generally perpendicularly from said separating line towards a second cut line, said second cut line extending generally perpendicularly from said first cut line towards a first fold line, said second cut line defining a third edge of said access flap.

7. The container of claim 4, further comprising an access flap formed from said second side panel, said access flap having a first edge defined by said separating line and a second edge defined by a first cut line extending away from said separating line, said access flap being configured such that pushing inwards on said access flap enables a user to more easily grasp said cover portion so as to more easily separate said cover portion from said tray portion.

8. The container of claim 1, wherein the separating line is formed from a plurality of line segments, at least some such line segments being cut lines and at least other such line segments being perforated lines, wherein a first portion of said separating line extending between said second front panel and said second side wall of said tray consists of a cut line.

9. A method of making a shipping and display container having a cover portion and a tray portion, the cover portion being separable from the tray portion, the method comprising:

cutting a profile of a single piece of material from a flat piece of material and forming a plurality of fold lines within the profile so as to form a plurality of interconnected panels from the single flat piece of material; and bisecting a plurality of panels by forming a separating line through said flat piece of material while maintaining the flat piece of material as a single piece of material, the separating line being a continuous line extending substantially across the length of the flat piece of material, wherein the separating line is formed from a plurality of line segments, at least some such line segments being cut lines and at least other such line segments being perforated lines, wherein folding the flat piece of material along the plurality of fold lines enables the shipping and display container to be moved from a flat knock-down configuration to a three-dimensional shipping configuration having:

opposed first and second side panels, each side panel comprising an upper portion and a lower portion;

a first front panel extending between respective front edges of the first and second side panels, the first front panel comprising an upper portion and a lower portion; and a second front panel coupled to the upper portion of the first front panel, the second front panel extending over the lower portion of the first front panel when the container is in the shipping configuration, thereby concealing the lower portion of the first front panel, wherein the upper and lower portions of the first front panel and the first and second side panels are bisected by the separating line, wherein the separating line is configured to retain respective upper portions of the first and second side panels to respective lower portions of the first and second side panels when the container is in the shipping configuration, wherein separating the shipping and display container at the separating line when the shipping and display container is in the three-dimensional shipping configuration causes the shipping container to be separated into a tray portion for displaying goods and a cover portion that can be discarded, wherein the tray portion comprises a front wall formed from the lower portion of the first front panel of the container and opposed first and second side walls formed from respective lower portions of the first and second side panels of the container, wherein the cover portion comprises a first front wall formed from the upper portion of the first front panel of the container and opposed first and second side walls formed from respective upper portions of the first and second side panels of the container, wherein the cover portion comprises the second front panel such that moving the container to the display configuration causes a front surface of the front wall of the tray to be revealed, wherein a proximal end of the second front panel is coupled to a first portion of the front edge of the second side panel and wherein an opposed distal end of the second front panel is positioned relatively adjacent to the front edge of the first side panel, the first portion of the front edge of the second side panel consisting of at least a portion of the front edge that is defined by the upper portion of the second side panel, and wherein a first portion of the separating line extends between the second front panel and the second side wall of the tray, the first portion of the separating line consisting of a cut line that is a complete cut between the second front panel and the second side wall of the tray such that the second front panel is not directly coupled to the second side wall of the tray portion when the container is in the shipping configuration.

10. The method of claim 9, further comprising cutting an access flap from a panel of the shipping and display container, the access flap having a first edge defined by the separating line and a second edge defined by a first cut line extending away from the separating line, the access flap being configured such that pushing inwards on the access flap enables a user to more easily grasp the cover portion so as to more easily separate the cover portion from the tray portion.

11. The method of claim 10, wherein the access flap is formed from a top portion of the panel, the top portion of the panel forming part of the cover portion.

12. The method of claim 10, wherein the first cut line extends generally perpendicularly from the separating line towards a second cut line, the second cut line extending generally perpendicularly from the first cut line towards a first fold line, the second cut line defining a third edge of said access flap.

13. The method of claim 12, wherein the second cut line extends generally perpendicularly from the first cut line towards a second fold line such that the separating line and the first and second cut lines define two access flaps, each being hingedly coupled to the panel at respective first and second fold lines.

14. The method of claim 9, further comprising cutting an aperture in a panel of the shipping and display container, the aperture being configured so as to enable a user to more easily grasp the cover portion so as to more easily separate the cover portion from the tray portion.

15. A method of displaying items, the method comprising:

providing a shipping and display container in a knock-down configuration the container comprising a plurality of bisected panels, each bisected panel being bisected by a separating line;

folding the container into a three-dimensional packing configuration such that the container comprises a cover portion that is removably coupled to a tray portion, wherein the cover portion and tray portion, together, define an interior area;

loading items into the interior area;

separating the plurality of bisected panels at the separating line so as to separate the cover portion from the tray portion, thereby revealing the items, wherein the container comprises:

opposed first and second side panels, each side panel comprising an upper portion and a lower portion;

a first front panel extending between respective front edges of the first and second side panels, the first front panel comprising an upper portion and a lower portion; and a second front panel coupled to the upper portion of the first front panel, the second front panel extending over the lower portion of the first front panel when the container is in the shipping configuration, thereby concealing the lower portion of the first front panel, wherein the upper and lower portions of the first front panel and the first and second side panels are bisected by the separating line, wherein the separating line is configured to retain respective upper portions of the first and second side panels to respective lower portions of the first and second side panels when the container is in the shipping configuration, wherein separating the shipping and display container at the separating line when the shipping and display container is in the three-dimensional shipping configuration causes the shipping container to be separated into a tray portion for displaying goods and a cover portion that can be discarded, wherein the tray portion comprises a front wall formed from the lower portion of the first front panel of the container and opposed first and second side walls formed from respective lower portions of the first and second side panels of the container, wherein the cover portion comprises a first front wall formed from the upper portion of the first front panel of the container and opposed first and second side walls formed from respective upper portions of the first and second side panels of the container, wherein the cover portion comprises the second front panel such that moving the container to the display configuration causes a front surface of the front wall of the tray to be revealed, wherein a proximal end of the second front panel is coupled to a first portion of the front edge of the second side panel and wherein an opposed distal end of the second front panel is positioned relatively adjacent to the front edge of the first side panel, the first portion of the front edge of the second side panel consisting of at least a portion of the front edge that is defined by the upper portion of the second side panel, and wherein a first portion of the separating line extends between the second front panel and the second side wall of the tray, the first portion of the separating line consisting of a cut line that is a complete cut between the second front panel and the second side wall of the tray such that the second front panel is not directly coupled to the second side wall of the tray portion when the container is in the shipping configuration.

* * * * *